US005970640A

United States Patent [19]

Farrow

[11] Patent Number: 5,970,640

[45] Date of Patent: Oct. 26, 1999

[54] INTEGRATED SHELF TALKER AND METHOD OF MAKING SAME

[75] Inventor: David L. Farrow, Trenton, Canada

[73] Assignee: Moore U.S.A. Inc., Grand Island, N.Y.

[21] Appl. No.: 08/895,725

[22] Filed: Jul. 17, 1997

[51] Int. Cl.[6] ..... G09F 3/10

[52] U.S. Cl. ..... 40/638; 40/674; 283/56; 283/79; 283/81; 428/41.7

[58] Field of Search ..... 40/630, 638, 674, 40/594, 661.09; 283/79, 56, 105, 81; 428/41.4, 41.7, 42.1, 43

[56] References Cited

U.S. PATENT DOCUMENTS

| | | | |
|---|---|---|---|
| 3,963,124 | 6/1976 | Banks | 40/674 X |
| 4,188,427 | 2/1980 | Grass | 40/674 X |
| 4,726,131 | 2/1988 | Cass | 40/638 |
| 5,139,836 | 8/1992 | Burke | 40/638 X |
| 5,154,956 | 10/1992 | Fradrich | 40/638 X |
| 5,217,775 | 6/1993 | Wedekind | 40/638 X |
| 5,227,209 | 7/1993 | Garland | 40/630 X |
| 5,240,789 | 8/1993 | Breen et al. | 40/638 X |
| 5,318,825 | 6/1994 | Naber | 40/638 X |

FOREIGN PATENT DOCUMENTS

| | | | |
|---|---|---|---|
| 0 488 813 A2 | 6/1992 | European Pat. Off. | 40/638 |

*Primary Examiner*—Brian K. Green
*Attorney, Agent, or Firm*—Bilicki and Simpson

[57] ABSTRACT

An integrated shelf talker, comprising a paper substrate having a front surface and a back surface, each of the front and back surfaces having first and second end edges and a medially disposed portion, the substrate having a vertical perforation along the entire length thereof and located in the medial portion of the front and back surfaces to divide the substrate into first and second sections, the substrate further having a strip of repositionable adhesive applied to the medial portion of one of the front and back surfaces such that when the substrate is separated into the first and second sections along the vertical perforation, each of the first and second end edges is free of adhesive.

6 Claims, 2 Drawing Sheets

FIG. 1
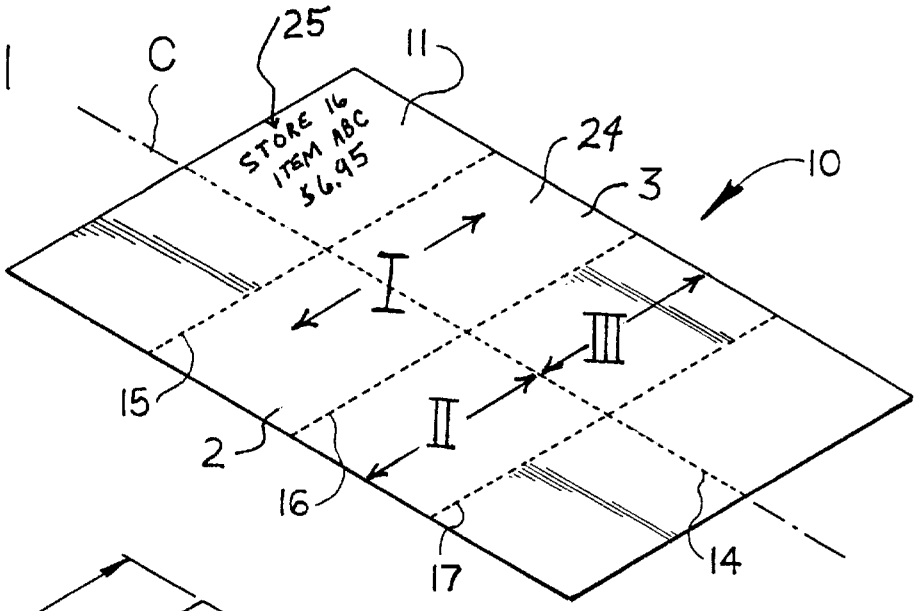
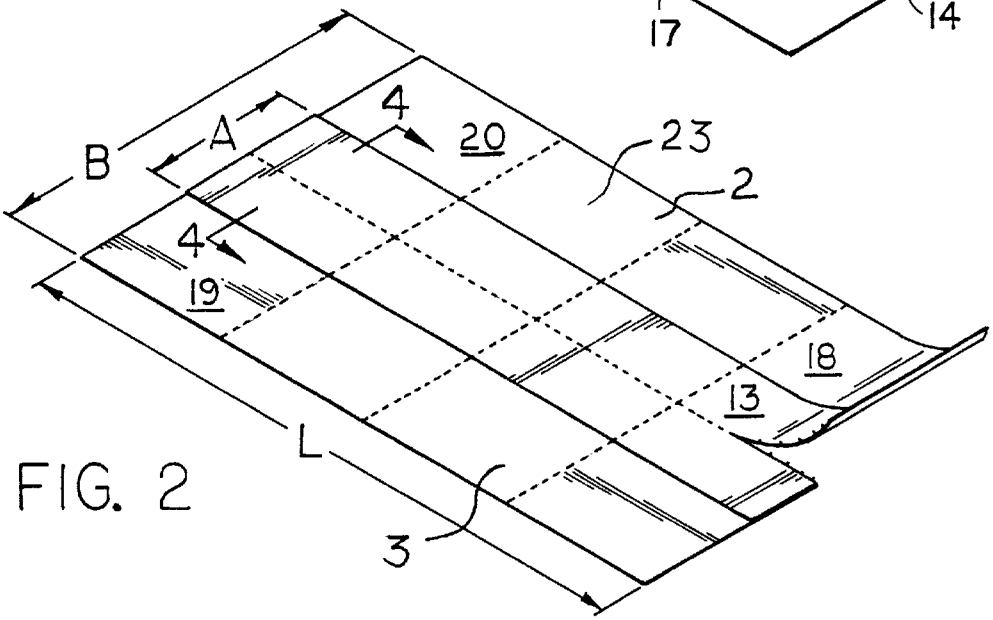
FIG. 2
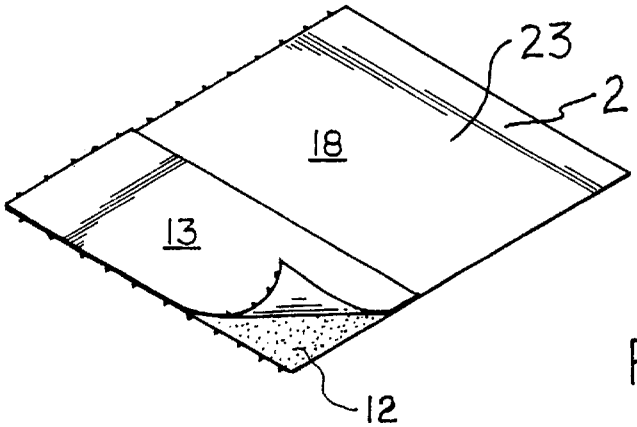
FIG. 3

INTEGRATED SHELF TALKER AND METHOD OF MAKING SAME

BACKGROUND OF THE INVENTION

The invention relates generally to bibs or shelf talkers, used primarily in retail stores. As anyone who shops in a grocery or convenience store will appreciate, "shelf talkers" or "bibs" are cards, signs or other printed material placed at the shelf locations of items for sale. Some shelf talkers are made of stiff plastic with ears to grip a standard "c" channel at a shelf edge. Other shelf talkers are made of vinyl and have an adhesive backing for attachment to a shelf edge. Still others are cards that are taped to shelf edges.

While vinyl shelf talkers are commonly used in the industry, they are relatively expensive and are known to curl in high moisture conditions (e.g., meat departments). Paper cards offer certain improvements over vinyl, but it is generally inconvenient to tape cards to shelf edges.

What is needed, then, is a less expensive alternative to vinyl shelf talkers which will not curl, is easily detached from a sheet, easily applied to a shelf, and does not require taping.

SUMMARY OF THE INVENTION

The invention broadly comprises an integrated shelf talker comprising a paper substrate having a front surface and a back surface, each of the front and back surfaces having first and second end edges and a medially disposed portion, the substrate having a vertical perforation along the entire length thereof and located in the medial portion of the front and back surfaces to divide the substrate into first and second sections, the substrate further having a strip of repositionable adhesive applied to the medial portion of one of the front and back surfaces such that when the substrate is separated into the first and second sections along the vertical perforation, each of the first and second end edges is free of adhesive.

A primary object of the invention to provide an economic shelf talker.

Another object of the invention is to provide a shelf talker which will not curl.

A further object of the invention is to provide a method of making a shelf talker.

These and other objects and advantages of the present invention will be readily appreciable from the following description of preferred embodiments of the invention and from the accompanying drawings and claims.

BRIEF DESCRIPTION OF THE DRAWINGS

FIG. 1 is a top perspective view of the integrated shelf talker of the invention;

FIG. 2 is a bottom perspective view of the integrated shelf talker of the invention;

FIG. 3 is a bottom perspective view of one of the shelf talker labels separated from the sheet;

DETAILED DESCRIPTION OF THE PREFERRED EMBODIMENT

Figure 4:
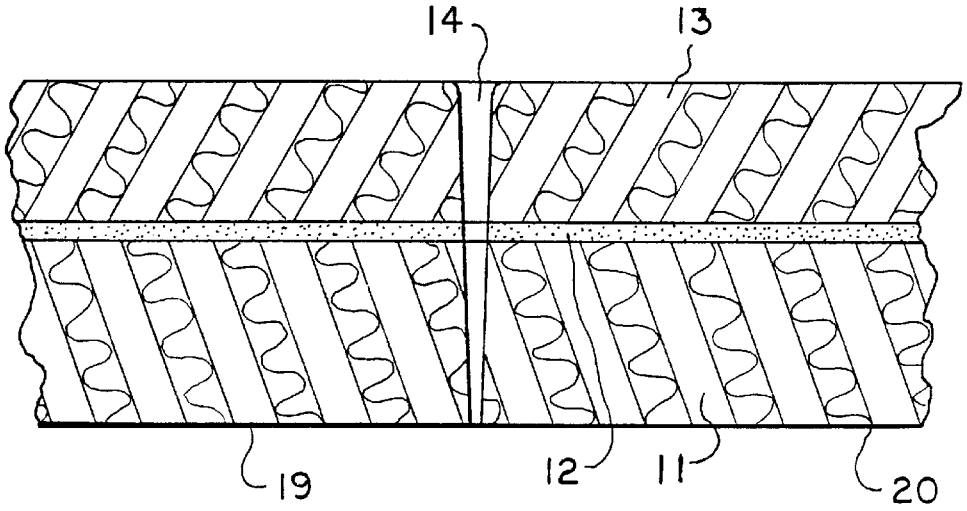
FIG. 4 is a cross-sectional view of the shelf talker taken generally along plane 4—4 in FIG. 2.

As illustrated in FIGS. I and 2, shelf talker 10 comprises paper substrate 11 having a front surface 24 and a back surface 23. Each of the front and back surfaces has a first end edge 2 and a second end edge 3, and a medially disposed portion I therebetween. The paper sheet may be of any suitable composition and weight but, preferably, has a face paper weight in the range of 45 pounds to 80 pounds (for a stack of 1000 sheets×17"×22").

The substrate contains a vertical perforation 14 along the entire length thereof and located in medial portion I. In the embodiment shown in FIG. 1, the vertical perforation is made along longitudinal centerline C. The vertical perforation divides the substrate sheet into first section II and second section III. The substrate also contains at least one additional perforation disposed transversely to the vertical perforation. In the embodiment shown in FIG. 1, additional perforations 15, 16 and 17 extend along the entire width of the sheet, and are disposed perpendicularly with respect to the vertical perforation.

With reference to FIGS. 2 and 3, back surface 23 of the paper sheet is coated with a strip of repositionable adhesive 12 which is applied to the medial portion I of the sheet. In the preferred embodiment shown, the adhesive is applied along the entire length L of the sheet and overlaps the longitudinal center C of the sheet. In FIG. 2, the adhesive is completely covered by liner 13, which will be described infra. Although the strip may have any appropriate width, in a preferred embodiment, the width A is approximately 25% of the width B of the sheet.

Repositionable adhesives are well known in the art, and a variety of tack levels are suitable for use in the present invention. One such suitable adhesive is CleanTac® brand adhesive available from Moore U.S.A. Inc. and Nacan Products Limited (Les Produits Nacan Itée), of Boucherville, Canada.

Once the adhesive is applied to the paper, a liner 13 is applied by conventional means to cover and protect the adhesive. Although various liners may be used, in a preferred embodiment a liner having a weight of 35–40 pounds with a silicone coating applied thereto was found to be suitable.

There are various methods available for applying the adhesive and liner to the substrate. One method is to apply the adhesive to the paper stock and then cover the adhesive with the liner. A second method is to apply adhesive to the liner material and then layer the liner with adhesive on the sheet. A third, but more expensive, method is to use transfer tape (liner and adhesive combined) and then simply unroll the transfer tape and apply it to the substrate.

Figure 5:
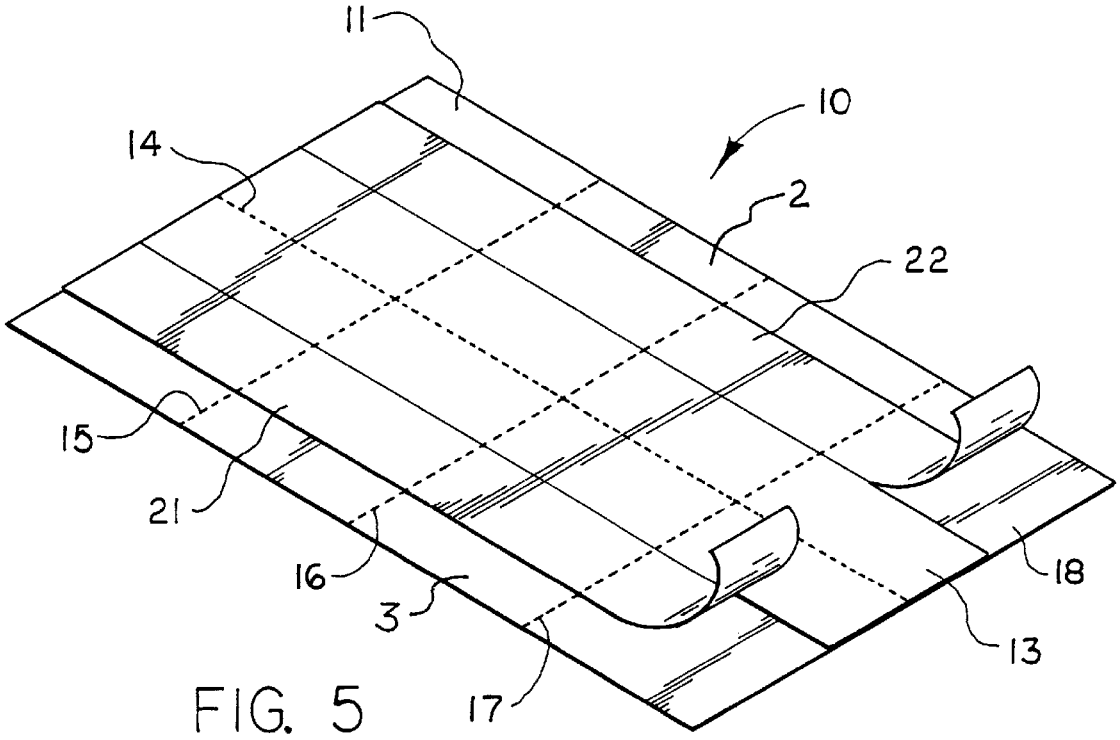
FIG. 5 is a view similar to FIG. 2, except showing the liner prior to trimming.

In the first method described above, and as shown in FIG. 5, an adhesive strip is applied to the paper stock (the adhesive strip is not visible in FIG. 5 as it is completely covered by liner 13). A liner which is substantially wider than the adhesive strip is then applied to the product, and then the excess width of the liner (21 and 22) is later trimmed, such that in the finished product the liner is substantially as wide as the strip of adhesive. For example, if the strip of adhesive is approximately two inches wide, a liner of approximately six inches in width may be applied, and later trimmed to a width of approximately two inches. The liner is applied by an adhesive coating machine, and the excess liner 21 and 22 is trimmed by a conventional cutter at the printing press.

The final step in manufacture is to perforate the integrated shelf talker. As previously described, vertical perforation 14 is applied along longitudinal axis C and transverse (perpendicular) perforations 15, 16 and 17 are equally spaced along the length of the sheet. Thus, it is seen that the vertical and transverse perforations create eight shelf talker labels of equal dimensions in a preferred embodiment, although obviously any number of labels can be made in a sheet, and the labels need not be of equal dimensions.

Application of the adhesive along and overlapping the longitudinal centerline permits creation of two adjacent rows of adhesive coated labels from a single adhesive strip. Adjacent labels 19 and 20 are illustrated in FIG. 2.

In FIG. 3, label 18 is shown detached from the sheet. Liner 13 is shown being peeled away to reveal repositionable adhesive 12. This drawing clearly shows that first end edge 2 is free of adhesive. (Second end edge 3 is similarly free of adhesive.)

FIG. 4 is a cross-sectional view of the shelf talker taken generally along plane 4—4 in FIG. 2. This view shows that the perforations are made in the paper 11, in the liner 13, and in the adhesive 12. This permits easy and efficient detachment of individual labels from the sheet.

Once the integrated shelf talker is manufactured, the sheet can be passed through a conventional printing press to print indicia thereon. The printed indicia 25 (shown in FIG. 1) is applied to the surface which is not coated with adhesive. In the preferred embodiment shown, adhesive is applied to back surface 23 and printed indicia is applied to front surface 24.

Although the invention is described by reference to a specific preferred embodiment, it is clear that variations can be made without departing from the spirit of the invention as claimed.

What I claim is:

1. An integrated shelf talker, comprising a paper substrate having a front surface and a back surface, each of said front and back surfaces having first and second edges and a medially disposed portion, said front surface having printed indicia thereon, said substrate having a vertical perforation along an entire length thereof and located in the medial portion of said front and back surfaces to divide said substrate into first and second sections, said substrate further having a single continuous strip of repositionable adhesive applied to said medial portion of said back surface and overlapping said vertical perforation such that when said substrate is separated into said first and second sections along said vertical perforation, each of said first and second sections retains a portion of said adhesive on said back surface after separation, said repositionable adhesive having a width less than a width of said substrate which spaces said repositionable adhesive from said first and second edges of said back surface, said shelf talker further comprising a removable liner secured to said repositionable adhesive, said vertical perforation perforating said substrate, said single continuous overlapping adhesive strip and said removable liner.

2. An integrated shelf talker as recited in claim 1, said substrate further comprising at least one additional perforation disposed transversely to said vertical perforation and extending along the entire width of said substrate.

3. An integrated shelf talker as recited in claim 2 wherein said at least one additional perforation is disposed perpendicularly with respect to said vertical perforation.

4. An integrated shelf talker as recited in claim 1 wherein said strip of repositionable adhesive is approximately 25% as wide as said substrate.

5. An integrated shelf talker as recited in claim 1 wherein said paper substrate has a face paper weight in the range of 45 pounds to 80 pounds (for a stack of 1000 sheets×17"×22").

6. An integrated shelf talker as recited in claim 1 wherein said liner has a weight of 35–40 pounds.

* * * * *